US005094638A

United States Patent [19]

Kobayashi

[11] Patent Number: 5,094,638

[45] Date of Patent: Mar. 10, 1992

[54] WATER VEHICLE

[75] Inventor: Noboru Kobayashi, Iwata, Japan

[73] Assignee: Yamaha Hatsudoki Kabushiki Kaisha, Shizuoka, Japan

[21] Appl. No.: 512,755

[22] Filed: Apr. 20, 1990

[30] Foreign Application Priority Data

Apr. 21, 1989 [JP] Japan ..... 1-103252

[51] Int. Cl.[5] ..... B63H 19/00

[52] U.S. Cl. ..... 440/33; 440/42

[58] Field of Search ..... 114/242, 246, 249, 250, 114/251, 253, 271–273, 284; 440/42, 33; 244/9, 2

[56] References Cited

U.S. PATENT DOCUMENTS

| | | | |
|---|---|---|---|
| 612,539 | 10/1898 | Bowick | 114/246 |
| 3,245,637 | 4/1966 | Eickmann | 244/2 |
| 3,503,574 | 3/1970 | Eickmann | 244/2 |
| 3,575,125 | 4/1971 | Welsh | 114/273 |
| 3,614,024 | 10/1971 | Millman | 114/261 X |
| 3,828,717 | 8/1974 | Nichols et al. | 440/42 |
| 4,417,706 | 11/1983 | Miller | 114/273 |

*Primary Examiner*—Edwin L. Swinehart

*Attorney, Agent, or Firm*—Ernest A. Beutler

[57] ABSTRACT

A water vehicle comprised of a tow unit having only an internal combustion engine and a propulsion unit for propelling the watercraft and which cannot accommodate a rider. A towed unit is towed by the tow unit and includes a control device for controlling the tow unit from the towed unit. The towed unit has a kite so that it can operate either on the water or in the air.

11 Claims, 7 Drawing Sheets

WATER VEHICLE

BACKGROUND OF THE INVENTION

This invention relates to a water vehicle and more particularly to an improved sporting type of water vehicle embodying a tow unit and a towed unit and wherein the tow unit can be operated by a rider on the towed unit.

There are a wide variety of water vehicles that are utilized for recreational purposes. Many of these vehicles are of the type that are towed behind another watercraft. For example, water skis and parasails are frequently employed for sporting purposes and are towed behind a powered tow unit. Although these devices are quite enjoyable to operate, a single person cannot use them. That is, an individual must, if he is to ride on the towed unit, have another person present in the towing watercraft so as to permit his use of the sport. This is an obvious disadvantage.

Also, it is necessary for the person using the towed craft to have access to a large self propelled watercraft that will convey the person operating the towing vehicle. As a result, the total cost of such an arrangement becomes very expensive. In addition, the size of the towing unit makes it difficult for the complete assemblage to be conveniently used by an individual on short notice and without substantial preparation.

It is, therefore, a principal object of this invention to provide an improved water vehicle.

It is a further object of this invention to provide an improved and simplified tow/towed unit that can be operated by a single person.

It is a further object of this invention to provide a tow/towed water unit that can be conveniently moved from place to place and used by a single person.

SUMMARY OF THE INVENTION

This invention is adapted to be embodied in a water vehicle comprised of a tow unit having a power source and a propulsion unit driven by a power source and a towed unit. The towed unit is configured to carry at least one rider and is connected to the tow unit by a tow device so as to be towed by the tow unit. Control means are carried by the towed unit to control at least one of the power source and propulsion unit by an operator on the towed unit.

DESCRIPTION OF THE PREFERRED EMBODIMENT OF THE INVENTION

Figure 1:
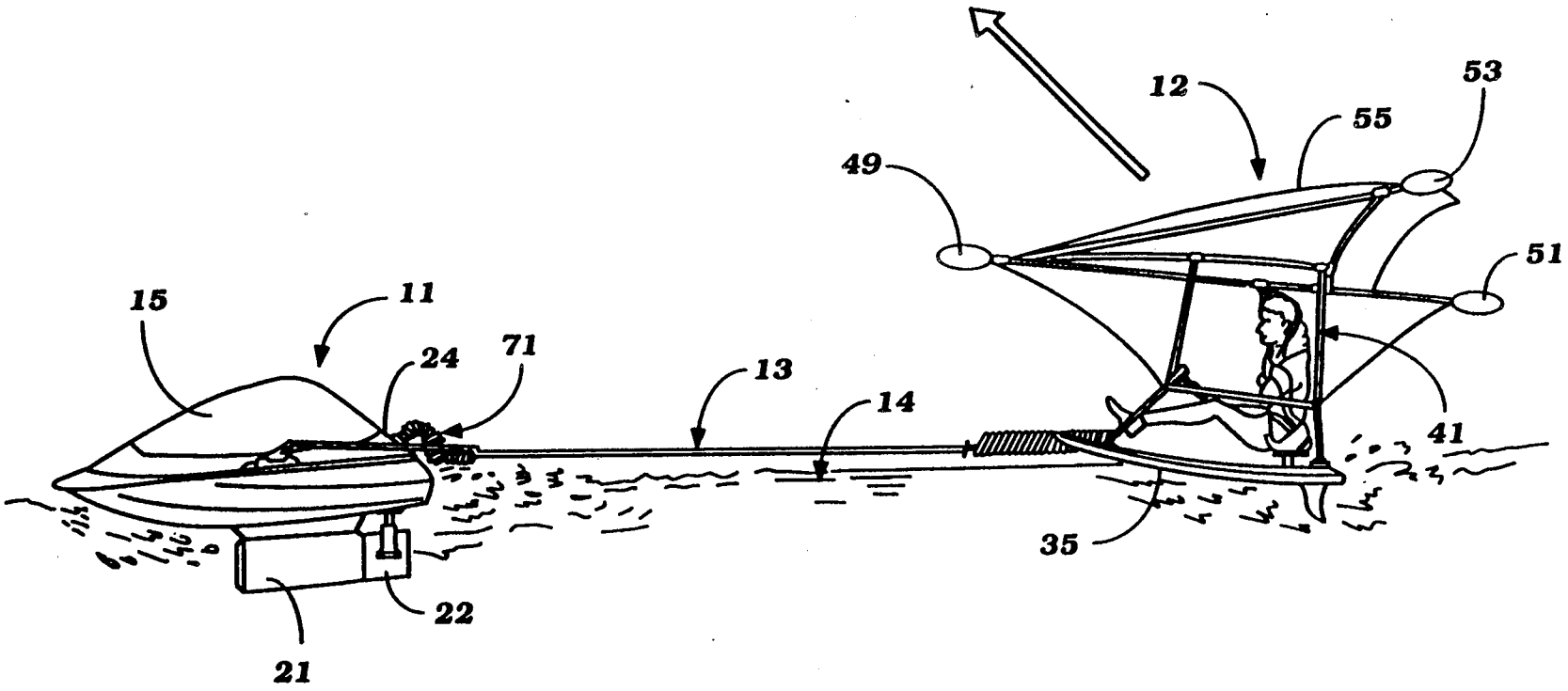
FIG. 1 is a side elevational view of a water vehicle constructed in accordance with the invention operating in one condition.
Figure 2:
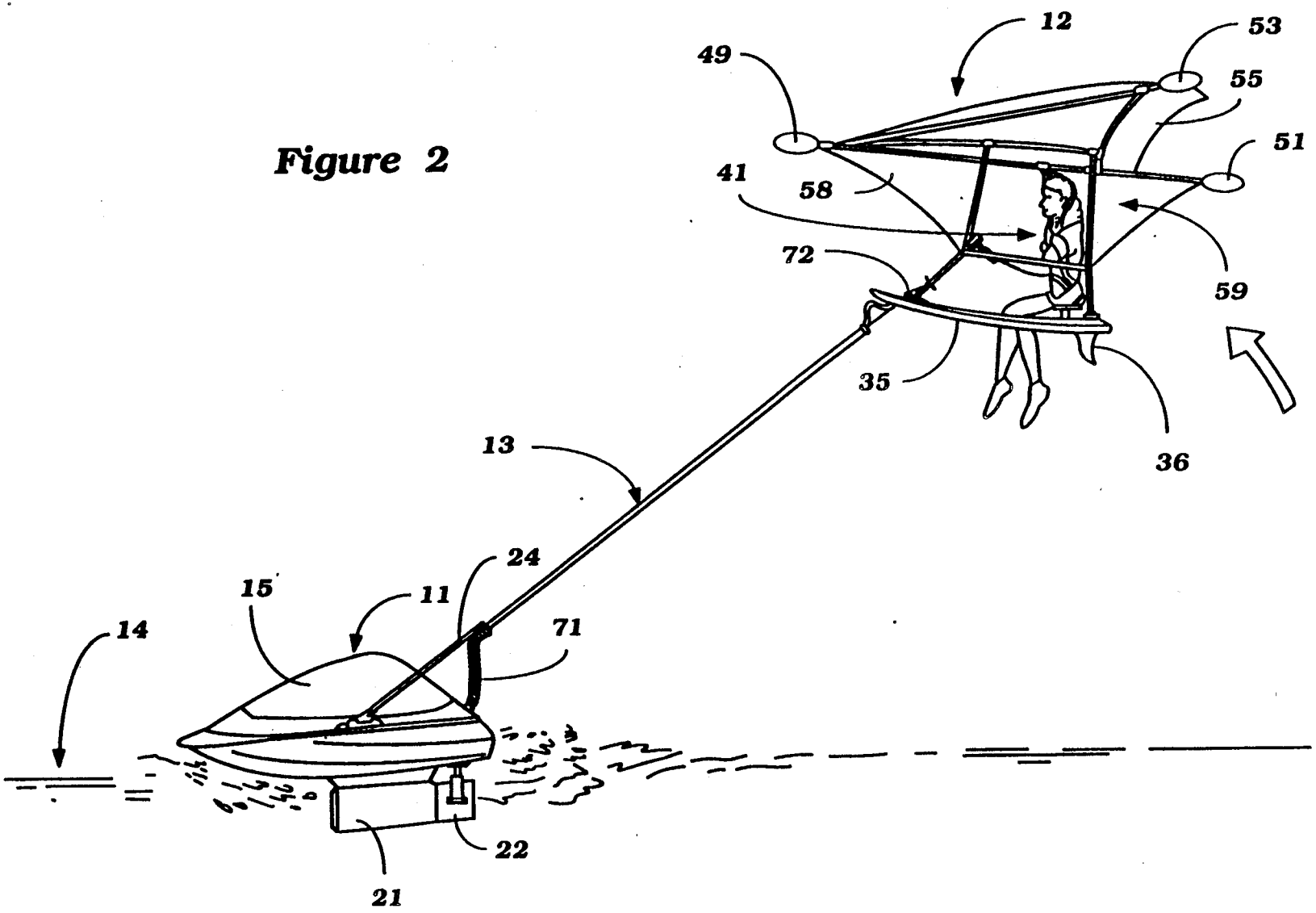
FIG. 2 is a side elevational view of the water vehicle operating in another condition.

Referring first to FIGS. 1 and 2, a water vehicle embodying the invention is illustrated in two of its operational modes. The water vehicle includes a tow unit 11 and a towed unit 12 that is connected to the tow unit 11 by means of a tow and control line assembly, indicated generally by the reference numeral 13. As will become apparent, the water vehicle is designed so as to be operated so that both the tow unit 11 and the towed unit 12 operate in the water, indicated by the water line 14 and as shown in FIG. 1 or wherein the towed unit 12 can glide through the air as shown in FIG. 2.

Figure 5:
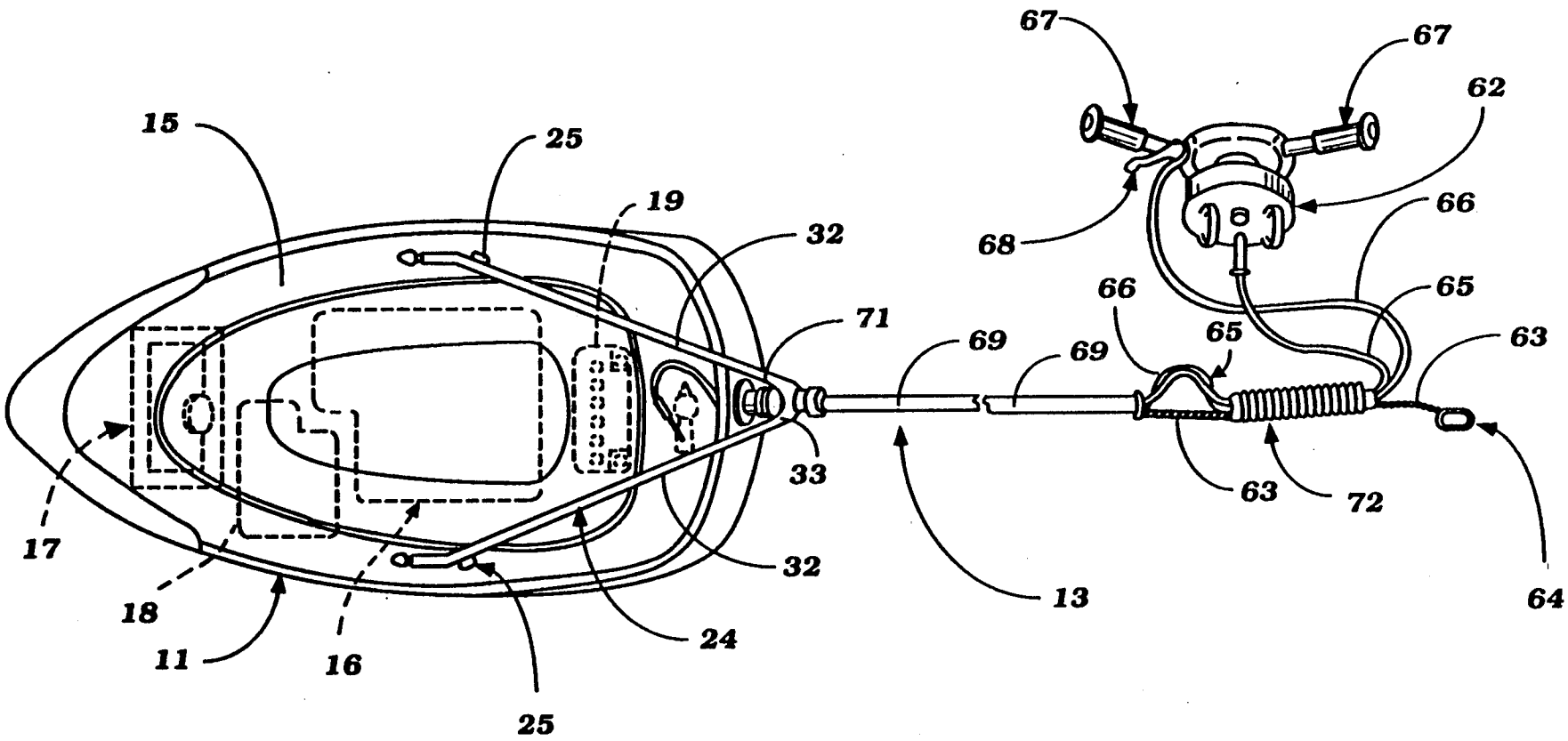
FIG. 5 is a top plan view of the towing unit with the control portion removed from the towed unit.
Figure 6:
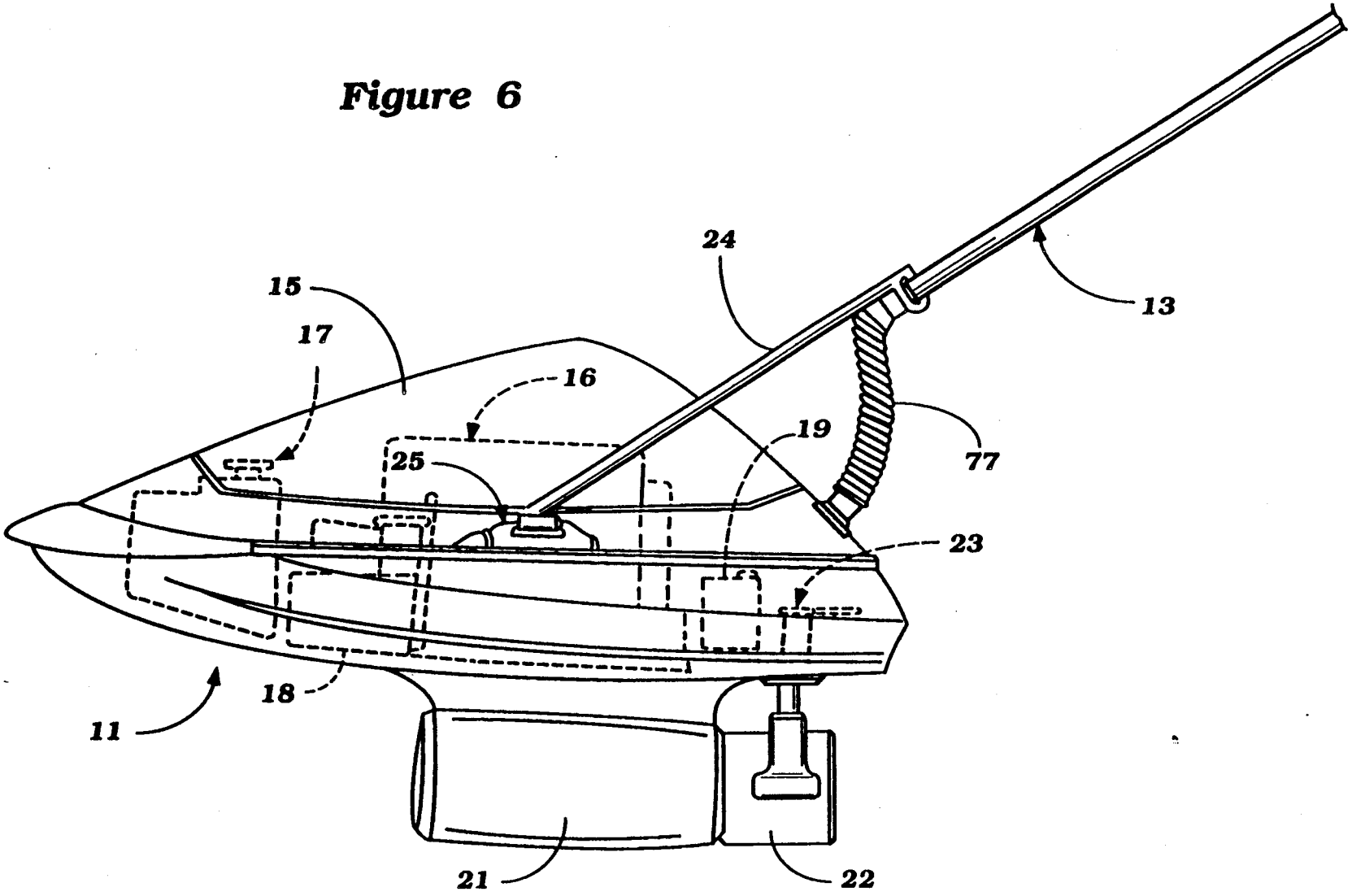
FIG. 6 is a side elevational view of the towing unit.

Referring now additionally to FIGS. 5 and 6, the tow unit 11 is comprised of a hull 15 which is generally too small to be ridden by a rider and only serves as the propulsion unit for the vehicle. The hull 15 supports an internal combustion engine 16 which may be of any known type such as a multi cylinder two cycle internal combustion engine. Of course, other types of propulsion units can be employed. Also positioned within the hull 15 is a fuel tank 17 for the engine 16 and a lubricant tank 18 therefor. A battery 19 is also supported to the rear of the hull 15 so as to provide good weight balance.

The engine 16 has an output shaft that drives a jet propulsion unit 21 that is mounted beneath the hull 15 and which operates in a known manner. The jet propulsion unit 21 has a pivotally supported discharge nozzle 22 that is steered by means of a tiller assembly 23 for steering of the unit 11 in a known manner. The tiller 23 is operated from the towed unit 12 in a manner to be described.

Figure 7:
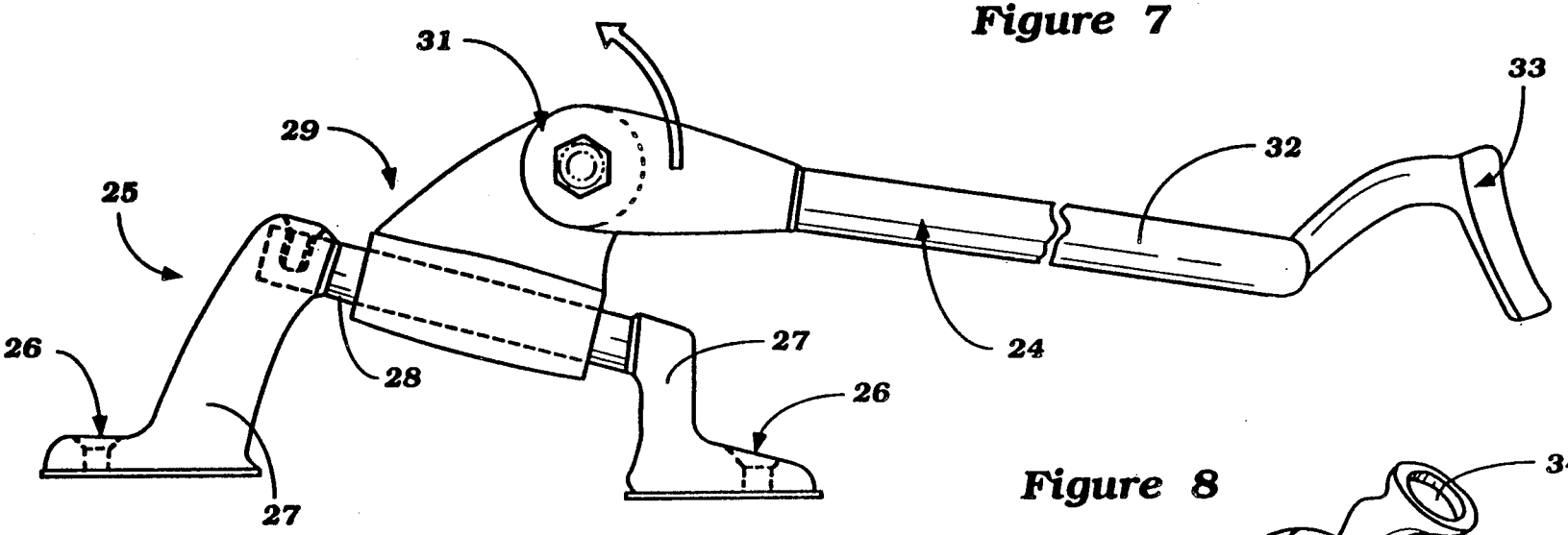
FIG. 7 is an enlarged side elevational view of the construction for attaching the towed unit to the tow unit.
Figure 8:
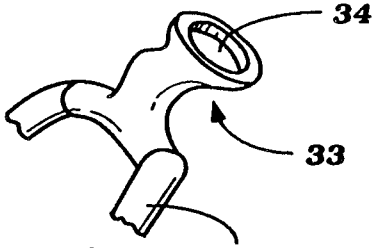
FIG. 8 is a partially exploding view of the attaching structure.
Figure 9:
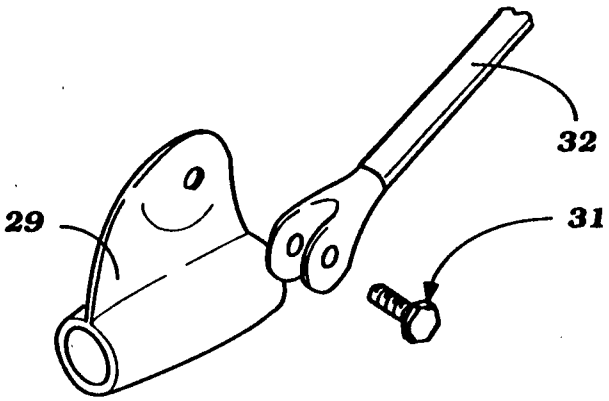
FIG. 9 is a top plan view of a portion of the attaching structure.
Figure 9:
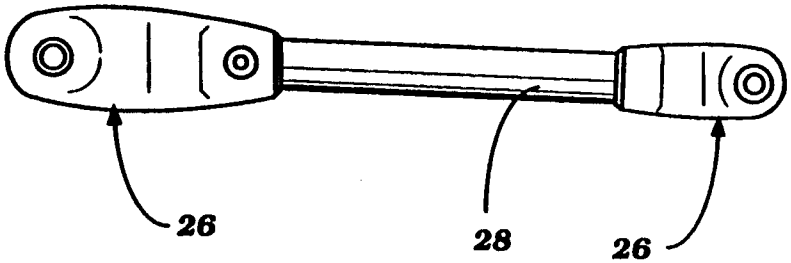

The tow and control cable assembly 13 is connected at its forward end to the tow unit 11 by means including a attachment bracket assembly 24 that is pivotally connected to the hull 15 and which has a construction as best shown in FIGS. 7 through 9 in addition to those figures already mentioned The assembly 24 includes a pair of attachment brackets, indicated generally by the reference numeral 25 and which comprise base portions 26 that have openings so as to receive attachment bolts for affixing them to the opposite sides of the hull 15. The brackets 26 have upstanding arm portions 27 that carry a rod 28 which, in turn, slidably supports an attachment member 29. The attachment member 29 has an upstanding ear that receives a pivot bolt 31 for attaching a respective arm 32 of a bifurcated handle portion of the assembly 24. The arms 32 merge at a common yoke 33 that has an opening 34 to pass the tow and control assembly 13.

Figure 3:
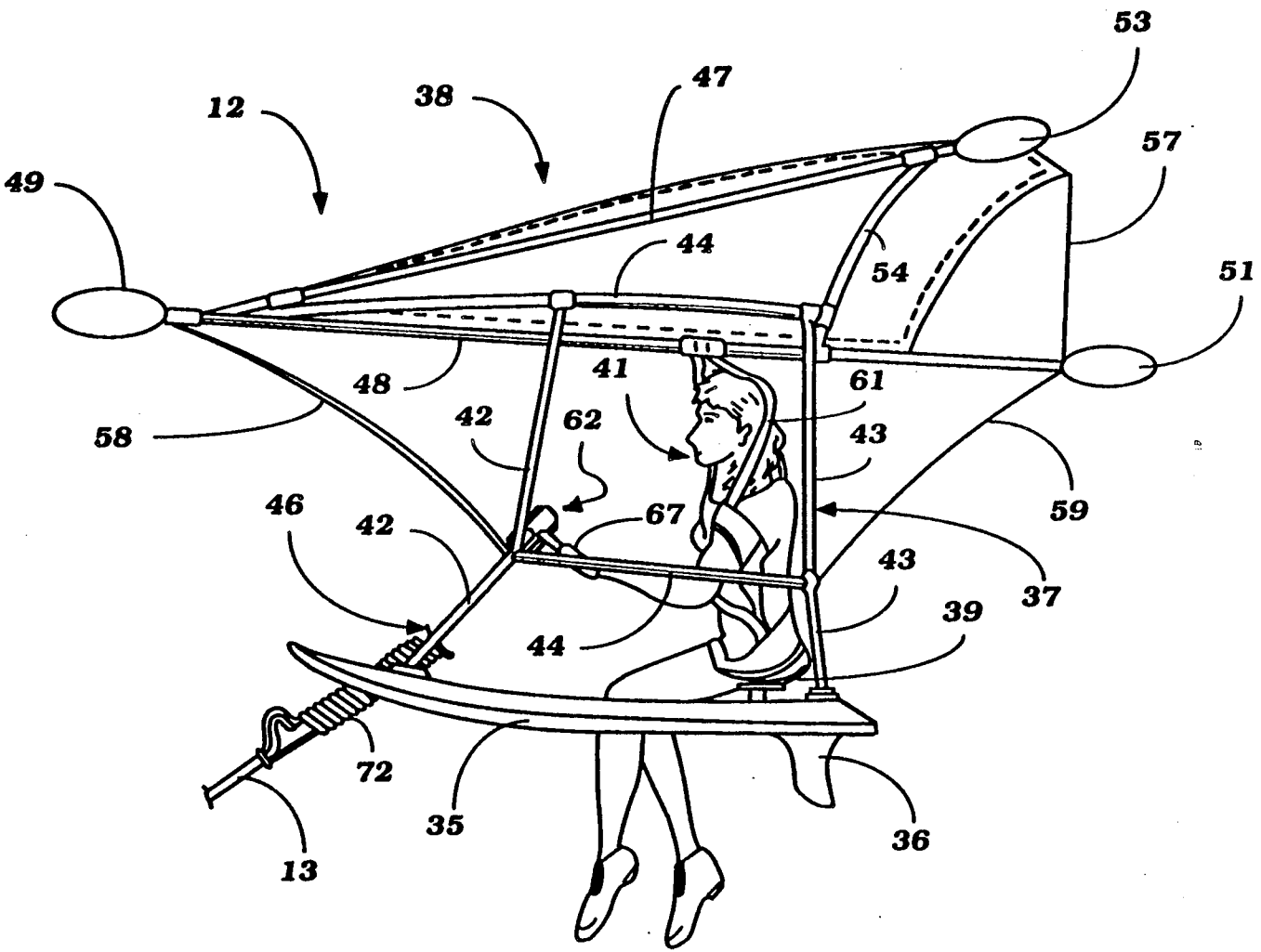
FIG. 3 is an enlarged side elevational view of the towed unit.
Figure 4:
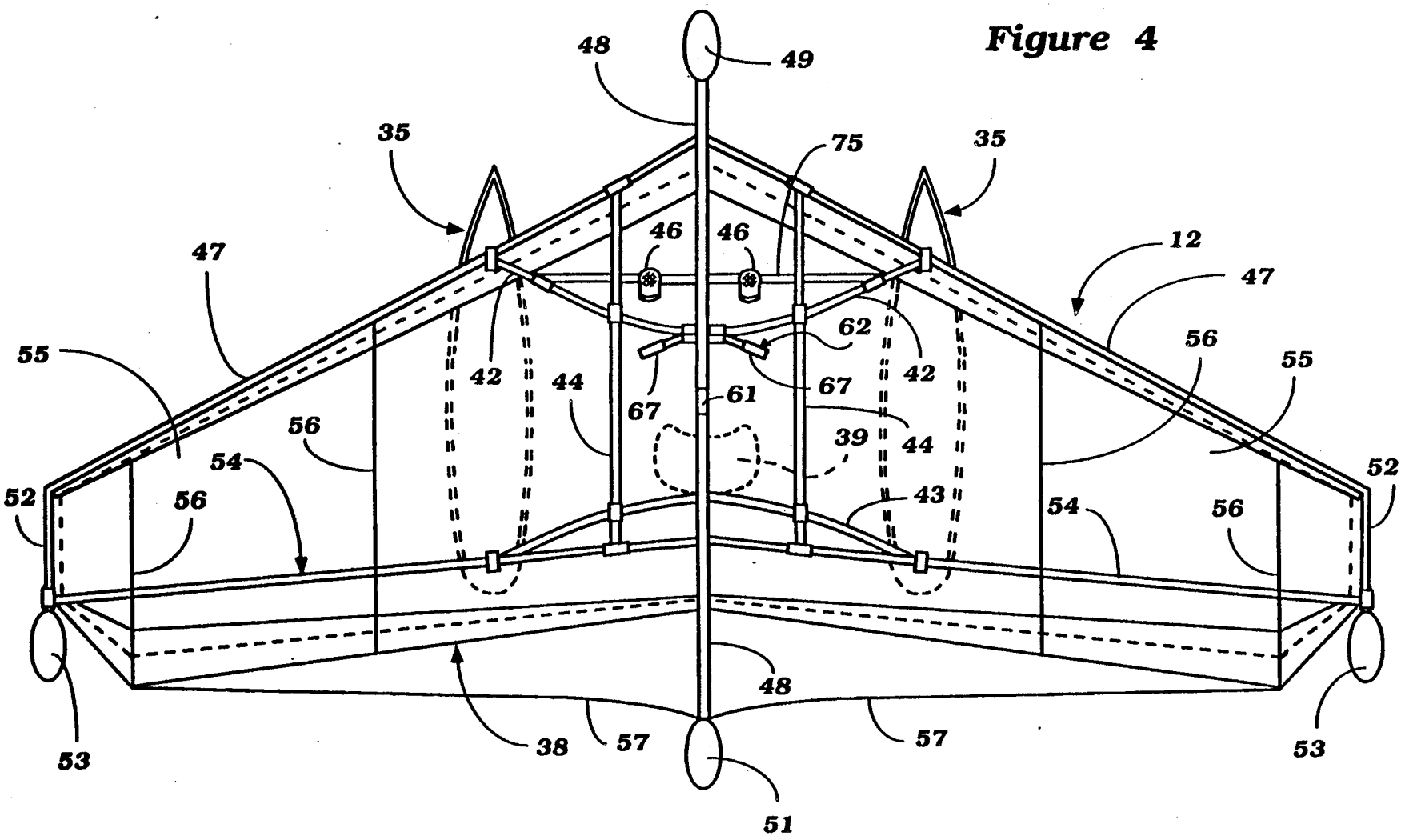
FIG. 4 is a top plan view of the towed unit.

Referring now in detail primarily to FIGS. 3 and 4, the towed unit 12 is comprised of a pair of floats 35 that have the configuration generally like a surf board and which have small stabilizing rudders 36 at the rear end thereof. A welded up tubular frame assembly, indicated generally by the reference numeral 37 is carried by the floats 35 and may be formed from a lightweight material such as aluminum.

The frame assembly 37 includes an upper portion that carries a kite, indicated generally by the reference numeral 38 so as to provide aerodynamic lift for the towed unit 12 so as to act like a parasail. In addition, a seat 39 is carried by the frame assembly 37 so as to accommodate a single rider, indicated by the reference numeral 41.

The frame assembly 37 includes generally a pair of angularly relate upstanding front members 42 and a pair of angularly related upstanding rear members 43. Pairs of lower and upper cross braces 44 extend at each side between the front members 42 and rear members 43 where the front and rear members 42 and 43 are each angularly related to themselves and at the tops thereof, respectively. A lower cross brace 45 extends across and joins the lower portions of the front members 42 and carries a pair of foot rests 46 on which the riders 41 may place their feet, primarily when traveling in the water-borne position as shown in FIG. 1.

The kite assembly 38 includes a tubular frame assembly which is carried at the upper portion of the frame assembly 37 and, therefore, actually forms an integral portion of it. This frame assembly includes a pair of angularly related forward members 47 that are connected to the frame members 42 and 43 of the frame assembly 37 at the upper ends of these members and which are also connected to a main central longitudinally extending member 48. The member 48 carries floats 49 and 51 at its front and rear ends, respectively. In a like manner, the frame members 47 have rearwardly extending portions 52 which extend generally parallel to each other and which carry floats 53 at their rear ends. It should be noted that the frame members 47 extend upwardly to a higher level than the main frame member 48.

The rear ends of the portions 52 of the frame members 47 are joined by a cross tube 54 that is angularly configured so as to also be attached to the upper ends of the frame tubes 43 of the main frame assembly 37. A fabric 55 is attached to the frame assembly as thus far described and is held in shape by the frame members as well as a plurality of longitudinally extending battens contained in seams 56 and guide wires 57. Further guide wires 58 and 59 extend between the main frame assembly 37 and the frame assembly of the kite 38 for reinforcing and stabilization purposes. The kite 38 has a generally gull wing configuration.

A safety harness 61 may be fastened to the frame member 48 of the kite assembly 38 s as to provide safety restraint for the rider 41 in the event that person becomes displaced from the seat 39.

It should be noted that the combined tow and control line 13 carries a control handle assembly 62 at its rear end which is adapted to be affixed to the frame assembly 37 in front of the seat 44 in an appropriate manner so as to permit the operator to control the tow unit 11 in a manner which will now be described by particular reference to FIG. 5.

It should be noted that the tow and control line 13 contains a wire or cable 63 that has an eyelet 64 at its rear end that is designed to be detachably connected to the lower portion of the frame assembly 37 so as to establish the towing connection between the tow unit 11 and the towed unit 12. The front of the cable 63 is detachably connected to the yoke 33 of the frame assembly 24.

There are also provided in the tow and control unit 13 a steering bowden wire cable 65 and a throttle control bowden wire cable 66. The steering bowden wire cable 65 is connected to a handlebar assembly 67 that is rotatably journaled by a base of the control unit 62 at the towed unit portion 12. The forward portion of the steering bowden wire 65 is connected to the tiller 23 for steering the steering nozzle 22 upon steering movement of the handlebar assembly 67.

A throttle control lever 68 is connected to one of the handlebars 67 and the to the throttle control bowden wire cable 66. The forward portion of the throttle control bowden wire 66 is connected in an appropriate manner to the throttle of the engine 16 so that the rider 41 may control the speed of travel.

A protective sheath 69 encircles the major portion of the length of the tow and control line 13 and specifically the tow cable 6 and bowden wire cable 65 and 66. Where the assembly is attached to the tow unit 11, a flexible boot 71 encircles and protects the bowden wire cables 65 and 66 where they pass through the hull 15 of this unit. In a like manner, a flexible boot 72 encircles the rear portion of the unit 13 where it is connected to the towed unit 12.

It should be readily apparent from the foregoing description that the described water vehicle can provide a great deal of sporting enjoyment for a single user without that user having to obtain the services of another person driving a towing vessel. In addition, the unit is extremely compact and can be easily transported by one person. Although a specific embodiment of the invention has been illustrated and described, various changes and modifications may be made. For example rather than using bowden wire controls, radio controls or other forms of controls may be employed. Also, other functions of the tow unit can be controlled by the towed unit. Such modifications fall within the spirit and scope of the invention, as defined by the appended claims.

I claim:

1. A water vehicle comprising a tow unit having a hull, a power source and a propulsion unit driven by said power source, said hull being configured and sized so as to not accommodate a rider thereon, a towed unit configured to carry at least one rider and connected to said tow unit by a tow device to be towed by said tow unit, said towed unit having flotation means being operable on the body of water on which the tow unit is operated and behind said tow unit and having fixed aerodynamic lift means for raising said flotation means and said towed unit above the body of water for operation in the air and above the body of water to provide for either in the water or in the air operation, and control means carried by said towed unit to control at least one of said power source and propulsion unit by an operator on said towed unit.

2. A water vehicle as set forth in claim 1 wherein the speed of the propulsion unit and the steering of the propulsion unit are both controlled by the control means.

3. A water vehicle as set forth in claim 2 wherein the towed unit has a seat on which the rider may be seated.

4. A water vehicle as set forth in claim 1 wherein the towed unit includes a kite for generating the aerodynamic lift to the towed unit.

5. A water vehicle as set forth in claim 4 wherein the propulsion device comprises a jet propulsion unit having a steerable discharge nozzle for steering of the tow unit.

6. A water vehicle as set forth in claim 5 wherein the speed of the propulsion unit and the steering of the propulsion unit are both controlled by the control means.

7. A water vehicle as set forth in claim 6 wherein the towed unit has a seat on which the rider may be seated.

8. A water vehicle as set forth in claim 4 wherein the speed of the propulsion unit and the steering of the propulsion unit are both controlled by the control means.

9. A water vehicles as set forth in claim 8 wherein the towed unit has a seat on which the rider may be seated.

10. A water vehicle as set forth in claim 1 wherein the towed unit comprises a generally open frame assembly carrying a fabric functioning as the kite.

11. A water vehicle as set forth in claim 10 wherein the frame assembly carries a seat above the flotation means and below the fabric for accommodating the rider.

* * * * *